US011620929B1

(12) United States Patent
Dai et al.

(10) Patent No.: US 11,620,929 B1
(45) Date of Patent: Apr. 4, 2023

(54) VOLTAGE ADJUSTMENTS FOR DISPLAY PANELS

(71) Applicant: Hewlett-Packard Development Company, L.P., Spring, TX (US)

(72) Inventors: Fangyong Dai, Spring, TX (US); Qijun Steve Chen, Spring, TX (US); Gabriel Hector Valencia, Spring, TX (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/534,375

(22) Filed: Nov. 23, 2021

(51) Int. Cl.
*G09G 3/20* (2006.01)

(52) U.S. Cl.
CPC ..... *G09G 3/20* (2013.01); *G09G 2330/021* (2013.01); *G09G 2330/12* (2013.01)

(58) Field of Classification Search
CPC ..... H02M 1/088; H02J 1/00; G06F 13/4068; G09G 3/20
See application file for complete search history.

(56) References Cited

U.S. PATENT DOCUMENTS

| | | | | |
|---|---|---|---|---|
| 7,068,264 | B2 | 6/2006 | Tomio | |
| 9,595,216 | B2 | 3/2017 | Park | |
| 9,824,615 | B2 | 11/2017 | Wang | |
| 10,283,076 | B1 | 5/2019 | Kim | |
| 2015/0091497 | A1* | 4/2015 | Leung | H02J 7/00 320/137 |
| 2017/0345381 | A1 | 11/2017 | Hou | |
| 2021/0397235 | A1* | 12/2021 | Schneider | G06F 13/4068 |
| 2022/0200452 | A1* | 6/2022 | Koki | H02M 1/088 |

* cited by examiner

*Primary Examiner* — Gerald Johnson
(74) *Attorney, Agent, or Firm* — Knobbe, Martens, Olson & Bear, LLP

(57) ABSTRACT

In some examples, an electronic device includes a display panel, voltage circuitry to provide a voltage output to the display panel, and a controller. In some examples, the controller sets the voltage output of the voltage circuitry to a first voltage. In some examples, the controller obtains a first display panel power measurement at the voltage output. In some examples, the controller compares the first display panel power measurement with a second display panel power measurement. In some examples, the controller changes the voltage output to a second voltage based on the comparison.

20 Claims, 5 Drawing Sheets

VOLTAGE ADJUSTMENTS FOR DISPLAY PANELS

BACKGROUND

Electronic technology has advanced to become virtually ubiquitous in society and has been used for many activities in society. For example, electronic devices are used to perform a variety of tasks, including work activities, communication, research, and entertainment. Different varieties of electronic circuitry may be utilized to provide different varieties of electronic technology.

DETAILED DESCRIPTION

Figure 1:
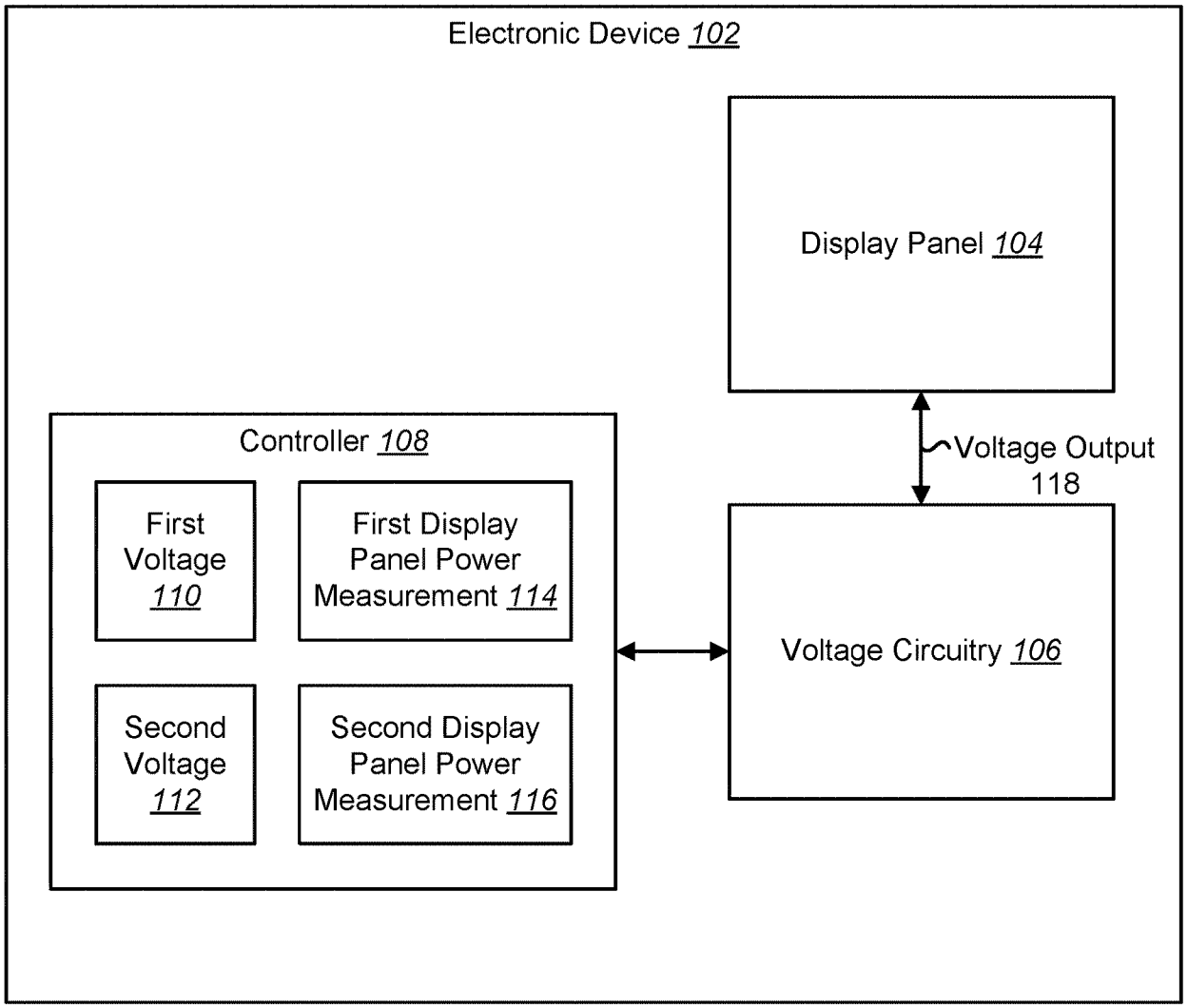
FIG. 1 is a block diagram illustrating an example of an electronic device to provide voltage adjustments for display panels.

Some examples of the techniques described herein relate to voltage adjustments for display panels used in electronic devices. An electronic device is a device that includes electronic circuitry (e.g., integrated circuitry). Examples of electronic devices include computing devices, laptop computers, desktop computers, smartphones, tablet devices, game consoles, etc. In some examples, electronic devices utilize circuitry (e.g., controller(s), processor(s), etc., or a combination thereof) to perform an operation. In some examples, electronic devices execute instructions stored in memory to perform the operation(s). Instructions may be code, programming, or a combination thereof that specifies functionality or operation of the circuitry. In some examples, instructions are stored in non-volatile memory (e.g., Read-Only Memory (ROM), Erasable Programmable Read-Only Memory (EPROM), Electrically Erasable Programmable Read-Only Memory (EEPROM), flash memory, Non-Volatile Random-Access Memory (NVRAM), etc.). In some examples, different circuitries in an electronic device store or utilize separate instructions for operation.

In some examples, the techniques described herein dynamically adjust the display panel input voltage in an electronic device to increase display panel power efficiency to increase battery life. The display panel power may vary according to various parameters including the type of material used in the display panel, the type of display panel, what features the display panel provides, etc. For example, an organic light-emitting diode (OLED) display panel has more internal power rails than a normal liquid-crystal display (LCD). When new functions are included in the display panel, such as an in-cell touchscreen or a pen display panel, more power rails may be included in the display panel.

While display panels generate various power rails internally, the display panel power source is still from a single power input external to the display panel. In some examples, an acceptable range for a single external power input is between 8V (volts) and 25V. The relationship between a display panel's power efficiency and the external input voltage varies within the range. As an example, a display panel may consume 5 W (watts) when the input voltage is 12V, but may consume 4.8 W when the input voltage is at 20V under the same operational conditions. Because of the complexities of display panels, difficulties exist in trying to predetermine a specific input voltage for the best display panel efficiency. For example, the optimal input voltage for the best display panel efficiency likely varies with the operational display panel mode, such as the brightness, the resolution, the display context, the frame rate, etc.

Throughout the drawings, similar reference numbers may designate similar or identical elements. When an element is referred to without a reference number, this may refer to the element generally, with or without limitation to any particular drawing or figure. In some examples, the drawings are not to scale, and the size of some parts may be exaggerated to more clearly illustrate the example shown. Moreover, the drawings provide examples in accordance with the description. The description is not limited to the examples provided in the drawings.

FIG. 1 is a block diagram illustrating an example of an electronic device 102 to provide voltage adjustments for display panels. The electronic device 102 includes or is coupled to a display panel 104 connected to voltage circuitry 106 in communication with a controller 108. In some examples, the voltage circuitry 106 provides a voltage output 118 to the display panel 104. The controller 108 sets the voltage output 118 of the voltage circuitry 106 to a first voltage 110 and obtains a first display panel power measurement 114 at the voltage output 118. The controller 108 compares the first display panel power measurement 114 with a second display panel power measurement 116 and changes the voltage output 118 to a second voltage 112 based on the comparison. In some examples, the controller 108 identifies the second voltage 112 by determining the lowest power measurement between the first display panel power measurement 114 and the second display panel power measurement 116. The second voltage 112 corresponds to the voltage output 118 that produced the lowest display panel power measurement or usage.

Examples of the electronic device 102 include a computer (e.g., laptop computer or desktop computer), a smartphone, a tablet computer, a portable game console, etc. In some examples, portions of the electronic device 102 are coupled via an interface (e.g., bus(es), wire(s), connector(s), etc.). For example, portions of the electronic device 102 or circuitries of the electronic device 102 are coupled via an inter-integrated circuit (I2C) interface. The portions or circuitries communicate via the interface.

The controller 108 is circuitry (e.g., integrated circuitry, semiconductor circuitry, electronic component(s), etc.) to control an aspect of the electronic device 102 operation or to control an aspect of a peripheral device in communication with the electronic device 102. For example, the controller 108 includes digital logic circuitry (e.g., a controller processor), transistors, memory, etc. In some examples, the controller 108 executes instructions or code to perform an operation.

In some examples, the controller 108 executes controller firmware having instructions to control the voltage adjustments for the display panel 104. Execution of the controller firmware causes the controller 108 to set the voltage output 118 of the voltage circuitry 106 to a certain voltage, obtain display panel power measurements, and compare display panel power measurements. Further details regarding the actions performed by the controller 108 executing firmware, instructions or code is provided herein.

As used herein, firmware may be instructions stored on a hardware device or electronic circuitry to operate the hardware device or electronic circuitry. Instructions included in firmware are code or programming that defines or controls functionality or operation of the hardware device or electronic circuitry. For example, some hardware devices or electronic circuitries execute firmware to perform an operation(s). For instance, firmware is executed to initialize, control, and/or operate the hardware device or electronic circuitry. In some examples, firmware includes instructions to control communication and/or interaction between the hardware device or electronic circuitry and other hardware or circuitry(ies) (e.g., a host electronic device). In some examples, firmware is stored in non-volatile memory (e.g., Read-Only Memory (ROM), Erasable Programmable Read-Only Memory (EPROM), Electrically Erasable Programmable Read-Only Memory (EEPROM), flash memory, etc.). In some examples, different circuitries in an electronic device store and/or utilize separate firmware for operation.

The electronic device 102 includes a display panel 104. The display panel 104 may be referred to as a monitor, touchscreen, screen, or display of the electronic device 102. In some examples, the display panel 104 includes circuitry (e.g., hardware) and/or instructions for presenting information to a user. In some examples, a display panel 104 is attached to or is external from the electronic device 102. The display panel 104 includes a power input port for providing power to the display panel 104. The power input port is used to connect a power source that is external to the display panel 104 to provide power to the display panel 104. Some examples of technologies used by the display panel 104 include an electroluminescent (ELD) display, a liquid crystal display (LCD), light-emitting diode (LED) backlit LCD, thin-film transistor (TFT) LCD, light-emitting diode (LED) display (e.g., organic light-emitting diode (OLED)), active-matrix LED (AMOLED) display, plasma (PDP) display, and/or quantum dot (QLED) display.

The electronic device 102 may include additional portions (e.g., components, circuitries, etc.) (not shown) or some of the portions described herein may be removed or modified without departing from the scope of this disclosure. In some examples, the electronic device 102 may include input/output (I/O) circuitry (e.g., port(s), interface circuitry, etc.), memory circuitry, input device(s), output device(s), etc., or a combination thereof. Examples of output devices include a display panel(s), speaker(s), headphone(s), etc. Examples of input devices include a keyboard, a mouse, a touch screen, camera, microphone, etc. In some examples, a user may input instructions or data into the electronic device 102 using an input device or devices.

Figure 2:
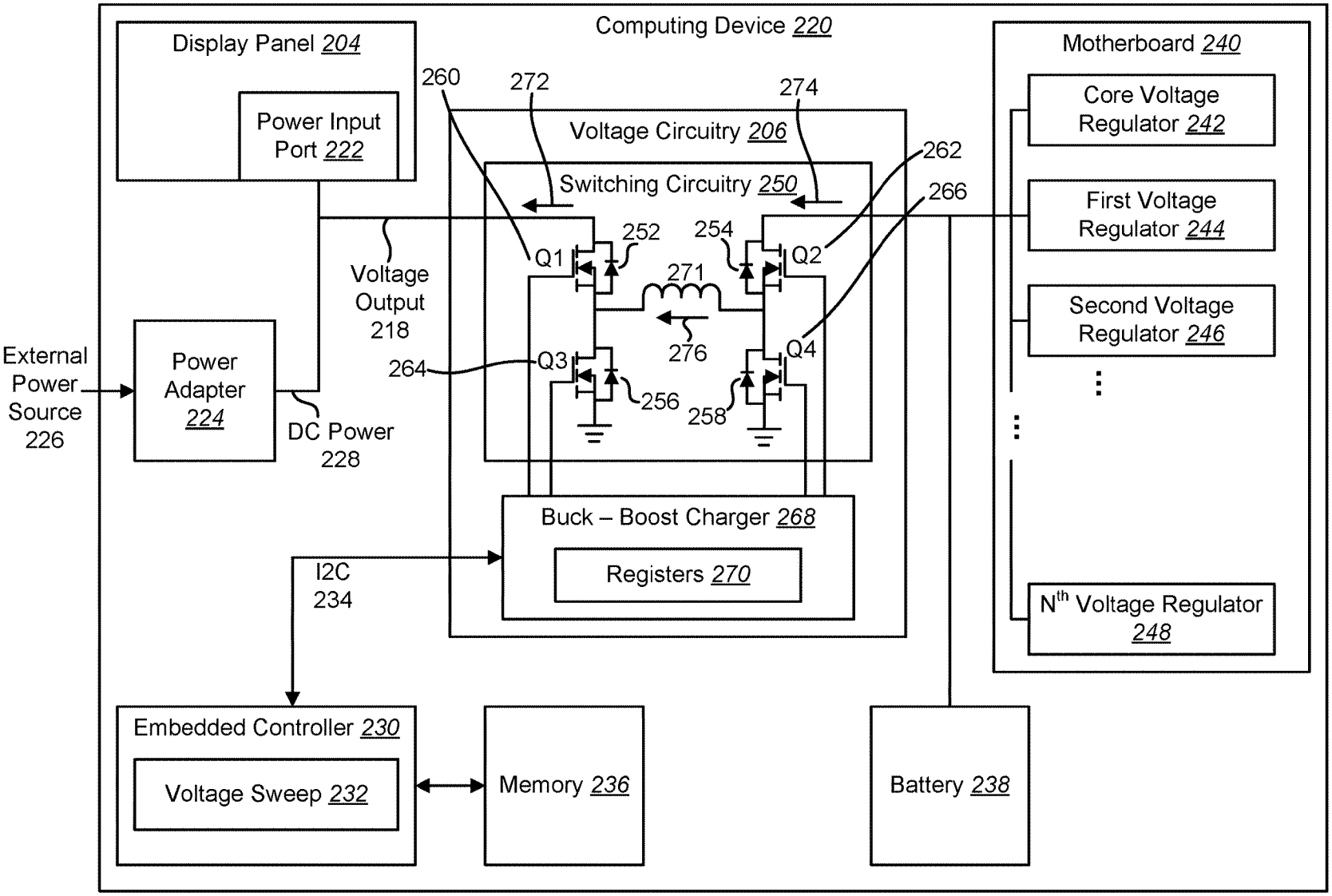
FIG. 2 is a block diagram illustrating an example of a computing device to provide voltage adjustments for display panels.

FIG. 2 is a block diagram illustrating an example of a computing device 220 to provide voltage adjustments for display panels 204. In some examples, the computing device 220 performs an aspect of the operations described in FIG. 1. The computing device 220 is an example of the electronic device 102 described in FIG. 1. In some examples, the computing device 220 includes or may be coupled to an embedded controller 230 in communication with voltage circuitry 206 and memory 236. The voltage circuitry 206 is coupled to a display panel 204 having a power input port 222, a battery 238, a power adapter 224 and a motherboard 240. In some examples, portions of the computing device 220 are coupled via an interface (e.g., bus(es), wire(s), connector(s), etc.). For example, portions of the computing device 220 or circuitries of the computing device 220 are coupled via an inter-integrated circuit (I2C) interface 234. The portions or circuitries communicate via the interface. For example, the embedded controller 230 is coupled to a buck-boost charger 268 via the 120 interface 234. Examples of the computing device 220 include a desktop computer, smartphone, laptop computer, tablet device, mobile device, etc. In some examples, one, some, or all of the components or elements of the computing device 220 are structured in hardware or circuitry. In some examples, the computing device 220 may perform one, some, or all of the operations described in FIGS. 1-5.

Power is provided to the computing device 220 either from an external power source 226, such as a wall outlet, or from the battery 238. The power adapter 224 converts the external power from the external power source 226 to direct current (DC) power 228. In some examples, the external power source 226 is a wall outlet providing alternating current (AC) power and the power adapter 224 converts the AC power into DC power 228. When the external power source 226 is plugged in, the power adapter 224 provides DC power 228 to the display panel 204 and to the voltage circuitry 206 that provides power to the motherboard 240 and to charge the battery 238. When the external power source 226 is not plugged in, power is provided to the computing device 220 from the battery 238. In other words, the voltage circuitry 206 charges the battery 238 when the computing device 220 is in a first power state (e.g., plugged in) and provides a voltage output 218 from the battery 238 to the display panel 204 when the computing device 220 is in a second power state (e.g., not plugged in). The second power state is also referred to as battery power mode.

The voltage circuitry 206 includes a buck-boost charger 268 and switching circuitry 250. The buck-boost charger 268 controls the voltage output 218 connected to the power input port 222 of the display panel 204. When the power adapter 224 is connected to an external power source 226, the display panel 204 is powered by the power adapter 224 output directly and the voltage circuitry 206 causes power to flow from the power adapter 224 to the battery 238 through the voltage circuitry 206 to charge the battery 238. When the power adapter 224 is not connected to an external power source 226, the voltage circuitry 206 reverses the direction of power flow such that power flows from the battery 238 to the display panel 204 through the voltage circuitry 206 as shown by the battery power paths (as shown by arrows 272, 274, 276) and the display panel 204 is powered by the battery indirectly. When on battery power the display panel 204 is powered by the battery 238 indirectly because the voltage circuitry 206 is between the battery 238 and the display panel 204. In other words, the battery 238 is not connected directly to the power input port 222 of the display panel 204 but the voltage circuitry 206 is connected directly to the power input port 222 of the display panel 204. With the circuitry connected as shown, when the computing device 220 is not plugged in, the display panel 204 receives various voltage levels as controlled by the voltage circuitry 206 and by the embedded controller 230. The voltage output 218 can be varied from below the battery 238 voltage to above the battery 238 voltage. The embedded controller 230 sets these various voltage output levels using charger registers 270 in the buck-boost charger 268 by the 120 interface 234.

In another example, another charger may be used instead of the buck-boost charger 268. For example, a hybrid charger that supports reverse mode using battery power as the input power may be used. The charger includes charging circuitry to charge the battery 238 and includes components to adjust the voltage output 218 as described with the techniques herein.

The switching circuitry 250 includes four transistors: a Q1 transistor 260, a Q2 transistor 262, a Q3 transistor 264, and a Q4 transistor 266. In some examples, the transistors are metal-oxide-semiconductor field-effect transistors (MOSFET). The drain of the Q1 transistor 260 is the voltage output 218 node. The source of the Q1 transistor 260 is coupled to the drain of the Q3 transistor 264. The source of the Q3 transistor 264 is tied to ground. The drain of the Q2 transistor 262 is coupled to the battery 238. The source of the Q2 transistor 262 is coupled to the drain of the Q4 transistor 266. The source of the Q4 transistor 266 is tied to ground. An inductor 271 is coupled between the source of the Q1 transistor 260 and the source of the Q2 transistor 262. A first diode 252 is coupled between the source and drain of the Q1 transistor 260 as shown. A second diode 254 is coupled between the source and drain of the Q2 transistor 262 as shown. A third diode 256 is coupled between the source and drain of the Q3 transistor 264 as shown. A fourth diode 258 is coupled between the source and drain of the Q4 transistor 266 as shown. By switching the transistors on and off, the voltage circuitry 206 controls the direction of power flow either from the power adapter 224 to the display panel 204 and the battery 238 or from the battery 238 to the display panel 204. For example, when in charger mode (power flows from the power adapter 224 to the battery 238) the embedded controller 230 turns Q2 transistor 262 ON (shorted) and turns Q4 transistor 266 OFF (open). In reverse mode (power flows from the battery 238 to the display panel 204) the embedded controller 230 turns Q1 transistor 260 ON and Q3 transistor 264 OFF, and causes Q2 transistor 262 and Q4 transistor 266 to operate in pulse width modulation (PWM) switching mode.

In some examples, an optimal power efficiency may be at the battery voltage. In such a case, the voltage circuitry 206 operates in pass-through mode: the buck-boost charger 268 turns on the Q1 transistor 260 and the Q2 transistor 262 (short through) and turns off the Q3 transistor 264 and the Q4 transistor 266 (open).

The buck-boost charger 268 regulates the voltage output 218 to the display panel 204 by regulating the voltage on drain of the Q1 transistor 260. The embedded controller 230 controls the output voltage by changing settings of the buck-boost charger 268 through the 120 interface 234. In some examples, the buck-boost charger 268 is in On-the-Go (OTG) mode to accomplish the techniques described herein.

When executing the voltage sweep 232 firmware or instructions, the embedded controller 230 measures or determines the power usage at the different voltage points. In some examples, the power is measured at the drain of the Q2 transistor 262. The voltage and the current are measured at the Q2 transistor 262 to determine the power usage at the specific voltage output 218 being applied.

In some examples, during a voltage sweep 232, the buck-boost charger 268 monitors and stores the various voltage outputs and current in the battery power paths 272, 274, 276 in memory. In some examples, the buck-boost charger 268 includes registers 270 that serve as memory. When these values are stored in registers 270 in the buck-boost charger 268, via the 120 interface 234 the embedded controller 230 accesses these values in the registers 270 to calculate or determine the display panel 204 power usage. The display panel power is the power usage of the display panel 204 at a particular output voltage. The panel power determined may include the buck-boost charger's power loss. In other words, the panel power usage may be reduced by the buck-boost charger's power loss.

The relationship between the voltage output 218 and power efficiency varies even on the same display panel when its operational mode changes in display content, resolution, refresh rate, brightness. The embedded controller 230 optimizes the power efficiency (minimizes the power usage by the display panel 204) with the voltage circuitry 206 by fine-tuning the voltage output 218 to the display panel 204 after its operation mode changes. By operating at a more power efficient voltage for the display panel 204, the battery 238 life can be extended.

The embedded controller 230 includes voltage sweep 232 instructions that, when executed, cause the embedded controller 230 to dynamically sweep through various voltage output levels and determine the most power efficient voltage output setting. The embedded controller 230 communicates with the voltage circuitry 206 via the 120 interface 234. Through the 120 interface 234 the embedded controller 230 sends commands to the buck-boost charger 268 and initiates the process by setting multiple different voltage outputs to the display panel 204, reading back subsequent current measurements from the buck-boost charger 268 for each voltage. With the current and the voltage, the embedded controller 230 then calculates or determines the power usage or power draw for each different voltage output 218 setting. The embedded controller 230 then selects the voltage level with the least power usage or power draw among the captured or swept voltage points for the display panel 204 input. The voltage sweep 232 is executed at various times whenever display panel power calibration is desired. In some examples, the display panel power usage can be initiated when a display mode changes, based on a timer setting, whenever the computing device 220 is powered on, etc. The display panel power usage calibration may run in parallel while the display panel 204 is active.

Figure 3:
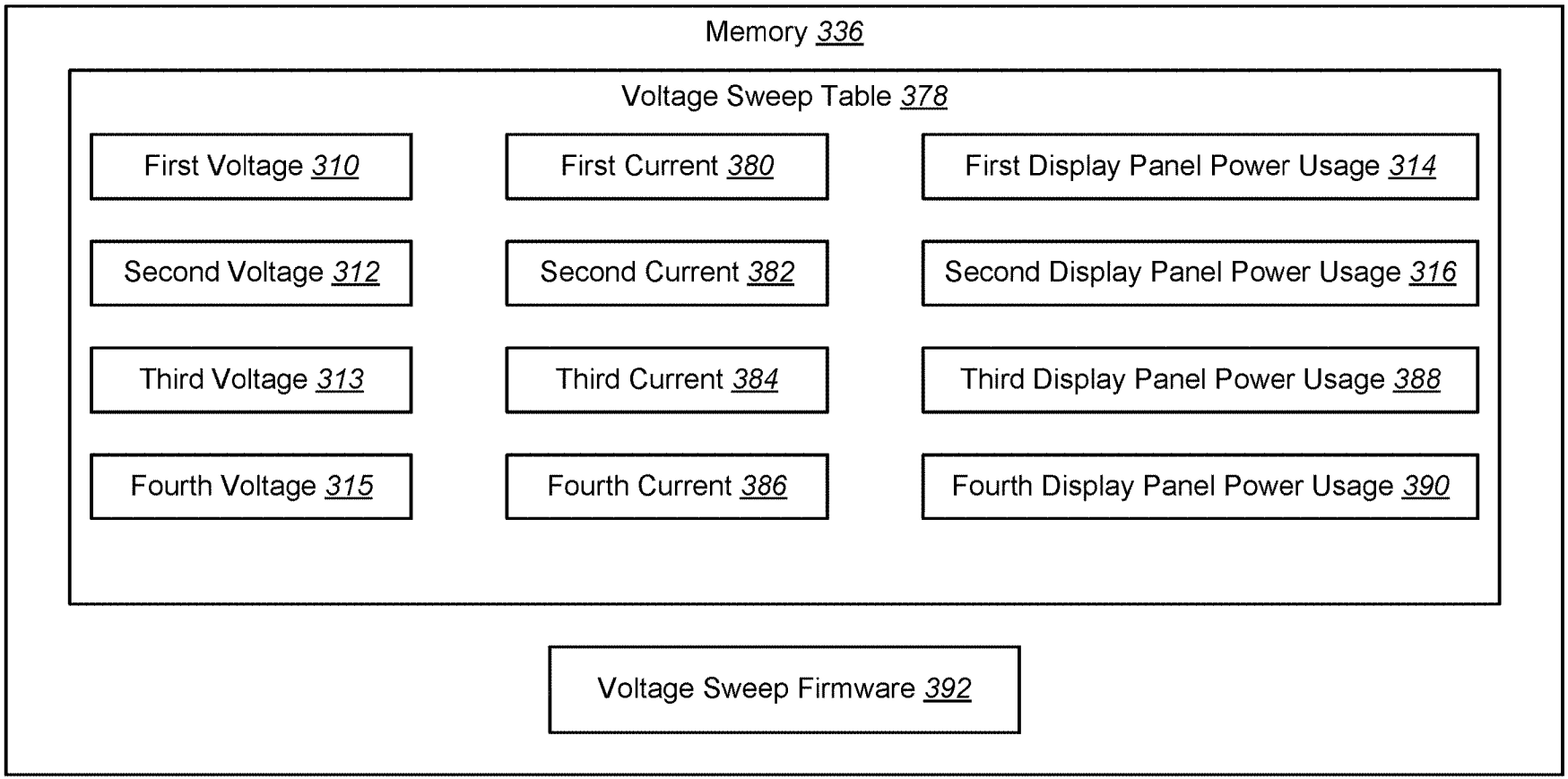
FIG. 3 is a block diagram illustrating an example of memory that may be used to provide voltage adjustments for display panels.

The memory 236 stores the voltage sweep 232 instructions or firmware and the instructions for executing the display panel power usage calibration. The embedded controller 230 uses the memory 236 to access firmware for execution and to store and access data stored. FIG. 3, below, illustrates more details with respect to the memory 236. In another example, some data may be stored in the buck-boost charger registers 270, such as voltage and current values, as described above.

In some examples, the memory 236 includes memory circuitry. The memory circuitry is electronic, magnetic, optical, or other physical storage device(s) that contains or stores electronic information (e.g., instructions, data, or a combination thereof). In some examples, the memory circuitry stores instructions for execution (by a processor, controller, or other component(s) of the computing device 220, or a combination thereof). The memory circuitry may be integrated into or separate from the element(s) described in FIG. 2. The memory circuitry may be, for example, Random Access Memory (RAM), Electrically Erasable Programmable Read-Only Memory (EEPROM), storage device(s), optical disc(s), or the like. In some examples, the memory circuitry may be volatile memory, non-volatile memory, or a combination thereof. Examples of memory circuitry may include Dynamic Random Access Memory (DRAM), EEPROM, magnetoresistive random-access memory (MRAM), phase change RAM (PCRAM), memristor, flash memory, or the like. In some examples, the memory circuitry may be non-transitory tangible machinereadable or computer-readable storage media, where the term "non-transitory" does not encompass transitory propagating signals.

The motherboard 240 receives power from either the battery 238 or the power adapter 224 through the voltage circuitry 206 depending on whether the power adapter 224 is connected to an external power source 226. The power to the motherboard 240 is connected to a core voltage regulator 242 and other voltage regulators including a first voltage regulator 244, a second voltage regulator 246 up to an Nth voltage regulator 248. The voltage regulators provide power to components on the motherboard 240. The core voltage regulator 242 provides power to a processor. The motherboard 240 includes additional portions, components, circuitries, etc. that are not shown in FIG. 2.

The processor executes instructions on the computing device 220 to perform an operation (e.g., execute application(s)). The processor may be a processor to perform an operation on the electronic device 102. Examples of the processor include a general-purpose processor, an application-specific integrated circuit, a microprocessor, etc. In some examples, the processor is an application processor.

FIG. 3 is a block diagram illustrating an example of memory 336 that may be used to provide voltage adjustments for display panels. In some examples, the memory 336 stores a voltage sweep table 378 and the voltage sweep firmware 392. The voltage sweep table 378 stores the voltages used during a voltage sweep. In some examples, the voltage sweep starts by setting the voltage output to a first voltage 310, then increments to a second voltage 312, a third voltage 313, and ends with a fourth voltage 315. At each voltage setting the voltage sweep table 378 stores the current at the voltage output, which is the current going through the battery power path. Accordingly, the voltage sweep table 378 stores a first current 380 corresponding to the current going through the battery power path when the voltage output is at the first voltage 310, a second current 382 corresponding to the current going through the battery power path when the voltage output is at the second voltage 312, a third current 384 corresponding to the current going through the battery power path when the voltage output is at the third voltage 313, and a fourth current 386 corresponding to the current going through the battery power path when the voltage output is at the fourth voltage 315. The embedded controller uses the voltage and current measurements or readings to then calculate or determine the display panel power usage or draw at each voltage setting. The embedded controller calculates the first display panel power usage 314 by using the first voltage 310 and the first current 380, the second display panel power usage 316 by using the second voltage 312 and the second current 382, the third display panel power usage 388 by using the third voltage 313 and the third current 384, and the fourth display panel power usage 390 by using the fourth voltage 315 and the fourth current 386. The embedded controller compares the different display panel power usages to identify the lowest panel power usage. The voltage sweep table 378 may include more points in the voltage sweep than the four shown in FIG. 3. Any number of points may be included in the sweep.

Figure 4:
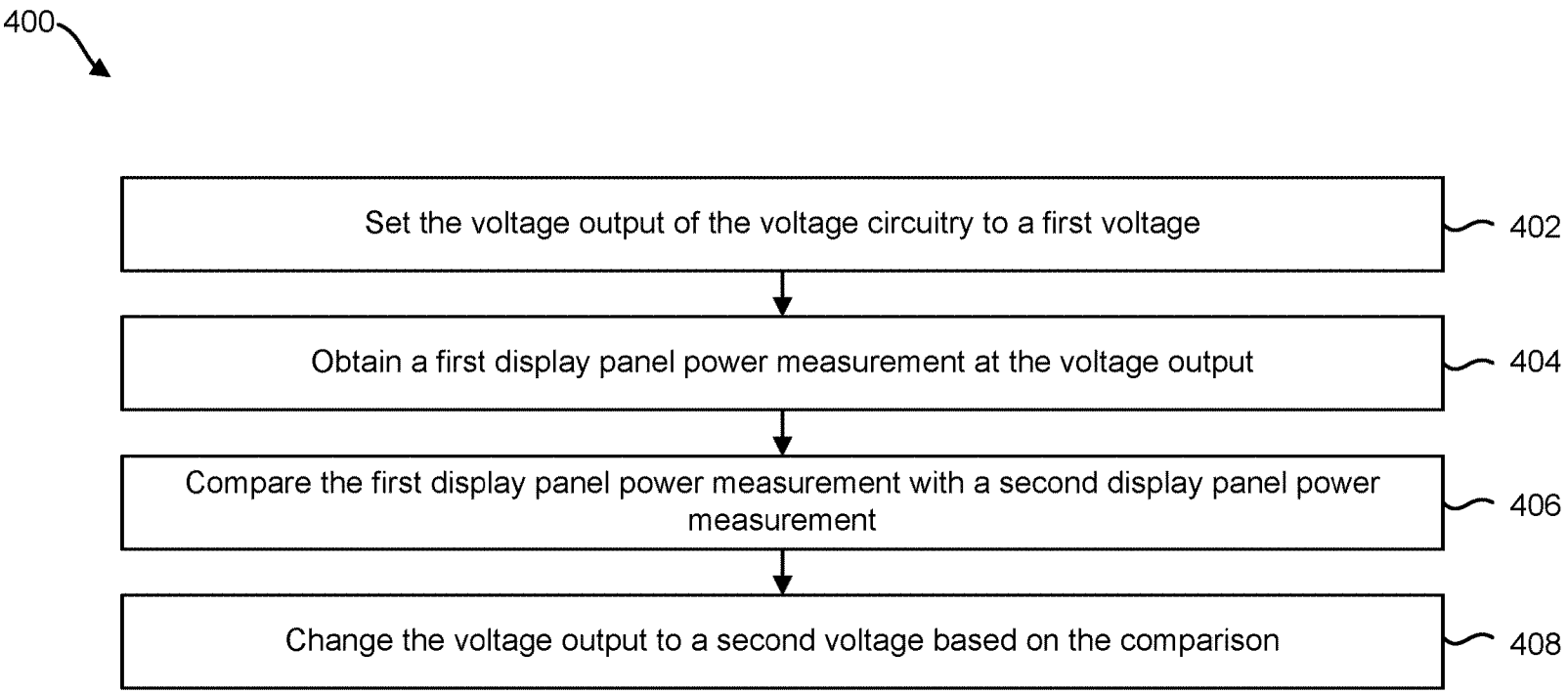
FIG. 4 is a flow diagram illustrating an example of a method to provide voltage adjustments for display panels.

FIG. 4 is a flow diagram illustrating an example of a method 400 for providing voltage adjustments for display panels in electronic devices. The method 400 or a method 400 element(s) may be performed by an electronic device, computing device, or apparatus (e.g., electronic device 102, apparatus, desktop computer, laptop computer, smartphone, tablet device, etc.). For example, the method 400 is performed by the electronic device 102 described in FIG. 1 or by the computing device 220 described in FIG. 2.

At 402, an electronic device sets the voltage output of the voltage circuitry to a first voltage. At 404, the electronic device obtains a first display panel power measurement at the voltage output. At 406, the electronic device compares the first display panel power measurement with a second display panel power measurement. At 408, the electronic device changes the voltage output to a second voltage based on the comparison.

Figure 5:
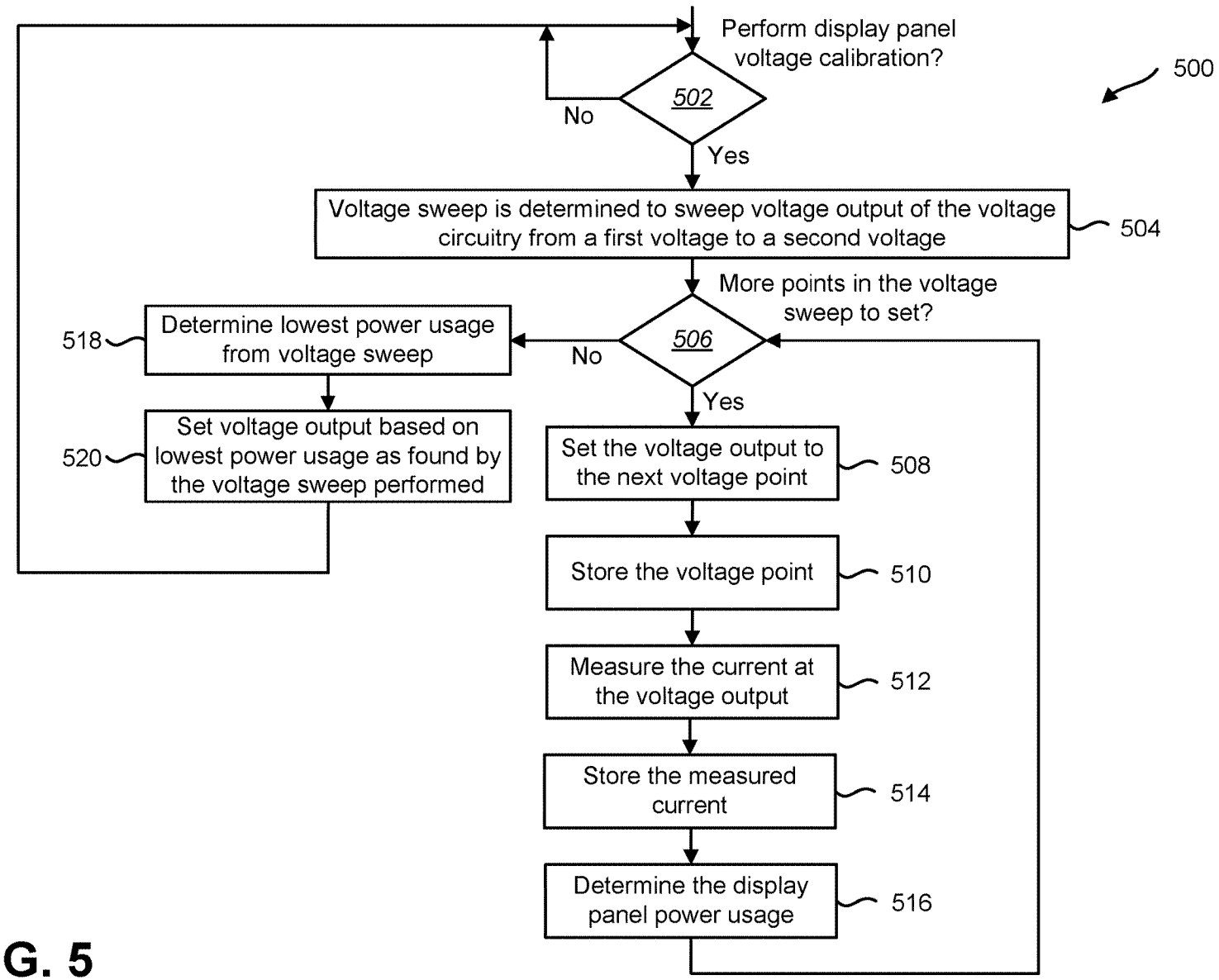
FIG. 5 is a flow diagram illustrating an example of a method to provide voltage adjustments for display panels.

FIG. 5 is a flow diagram illustrating an example of a method 500 for providing voltage adjustments for display panels in computing devices. The method 500 or a method 500 element(s) is performed by an electronic device, computing device or apparatus (e.g., electronic device 102, apparatus, desktop computer, laptop computer, smartphone, tablet device, etc.). For example, the method 500 is performed by the electronic device 102 described in FIG. 1 or by the computing device 220 described in FIG. 2.

At 502, the embedded controller determines whether a display panel voltage calibration is to be performed. In some examples, the display panel voltage calibration is to be performed when a display mode changes, or when a timer runs out, or when the computing device is powered on. Thus, the display panel voltage calibration is dynamically performed to adjust the voltage output to the display panel. If the display panel voltage calibration is to be performed, the method proceeds to 504. If calibration is not to be performed, the method returns to 502.

At 504, a voltage sweep is determined to sweep the voltage output of the voltage circuitry from a first voltage to a second voltage. In some examples, determining the voltage sweep includes setting the number of points or steps to include in the voltage sweep. In another example, a fixed voltage step size may be determined to sweep the voltage output by a fixed step size from a starting voltage to an ending voltage.

At 506, the embedded controller determines whether there are more points in the voltage sweep to set. If there are more points in the voltage sweep to set, the method proceeds to 508. If there are no more points in the voltage sweep, the method proceeds to 518.

At 508, the embedded controller sets the voltage output to the next voltage point. At 510, the voltage point is stored. At 512, the current at the voltage output is measured. At 514, the measured current is stored. At 516, the display panel power usage is determined for the given voltage setting and current measurement. The method then returns to 506.

At 518, the embedded controller determines a lowest power usage from the voltage sweep. In some examples, the embedded controller compares the already determined or calculated display panel power usages. In other examples, the embedded controller accesses the stored voltages and currents and calculates the power used at 518.

At 520, the embedded controller sets the voltage output based on the lowest power usage as found by the voltage sweep performed.

As used herein, items described with the term "or a combination thereof" may mean an item or items. For example, the phrase "A, B, C, or a combination thereof" may mean any of: A (without B and C), B (without A and C), C (without A and B), A and B (without C), B and C (without A), A and C (without B), or all of A, B, and C.

While various examples are described herein, the described techniques are not limited to the examples. Variations of the examples are within the scope of the disclosure.

For example, operation(s), aspect(s), or element(s) of the examples described herein may be omitted or combined.

What is claimed is:

1. An electronic device, comprising:

a display panel;

voltage circuitry to provide a voltage output to the display panel;

a power adapter path to the display panel independent of switching circuitry; and a controller to:

set the voltage output of the voltage circuitry to a first voltage;

obtain a first display panel power measurement at the voltage output;

compare the first display panel power measurement with a second display panel power measurement; and change the voltage output to a second voltage based on the comparison.

2. The electronic device of claim 1, wherein the voltage circuitry comprises charging circuitry to charge a battery.

3. The electronic device of claim 2, wherein power is provided to the display panel through the voltage circuitry from the battery when in a battery power mode.

4. The electronic device of claim 2, wherein the charging circuitry comprises a buck-boost charger.

5. The electronic device of claim 2, wherein setting the voltage output of the voltage circuitry comprises sending a command on an inter-integrated circuit (I2C) interface.

6. A computing device, comprising:

switching circuitry to charge a battery when the computing device is in a first power state and to provide a voltage output from the battery to a display panel when the computing device is in a second power state;

a power adapter path to the display panel independent of the switching circuitry; and a controller to:

set the voltage output from the battery to the display panel to a first voltage;

measure a first current at the first voltage;

set the voltage output from the battery to the display panel to a second voltage;

measure a second current at the second voltage; and set the voltage output from the battery to the display panel based on a comparison of a first panel power and a second panel power.

7. The computing device of claim 6, wherein the controller is to determine the first panel power using the first voltage and the first current and is to determine the second panel power using the second voltage and the second current.

8. The computing device of claim 6, wherein the switching circuitry couples the battery to the display panel.

9. The computing device of claim 6, wherein the voltage output of the switching circuitry is directly coupled to a power input port of the display panel.

10. The computing device of claim 6, further comprising a buck-boost charger coupled to the switching circuitry and coupled to the controller.

11. The computing device of claim 10, wherein the controller sets the voltage output from the battery to the display panel using charger registers in the buck-boost charger.

12. The computing device of claim 6, wherein the switching circuitry includes two transistors operating in pulse width modulation (PWM) switching mode when the computing device is in the second power state.

13. A computing device, comprising:

a display panel;

voltage circuitry to provide a voltage output to the display panel;

a power adapter path to the display panel independent of switching circuitry; and a controller to:

sweep the voltage output of the voltage circuitry from a first voltage to a second voltage;

determine power during the voltage sweep from a first power usage to a second power usage;

determine a lowest power usage from the voltage sweep; and set the voltage output based on the lowest power usage.

14. The computing device of claim 13, wherein the voltage circuitry comprises a buck-boost charger and the switching circuitry, wherein the buck-boost charger is coupled to the switching circuitry and to the controller, and wherein the switching circuitry is coupled to the display panel and to a battery.

15. The computing device of claim 14, wherein the buck-boost charger is in on-the-go (OTG) mode.

16. The computing device of claim 14, wherein the buck-boost charger stores the first voltage and the second voltage in registers.

17. The computing device of claim 16, wherein the controller is to access values in the registers.

18. The computing device of claim 13, wherein the voltage circuitry comprises a hybrid charger and switching circuitry, wherein the hybrid charger is coupled to the switching circuitry and to the controller, and wherein the switching circuitry is coupled to the display panel and to a battery.

19. The computing device of claim 13, wherein the first power usage is reduced by a buck-boost charger power loss.

20. The computing device of claim 13, wherein the controller is to set a number of points to include in the voltage sweep.

* * * * *